US006178226B1

(12) United States Patent
Hell et al.

(10) Patent No.: US 6,178,226 B1
(45) Date of Patent: Jan. 23, 2001

(54) METHOD FOR CONTROLLING THE ELECTRON CURRENT IN AN X-RAY TUBE, AND X-RAY SYSTEM OPERATING ACCORDING TO THE METHOD

(75) Inventors: Erich Hell, Erlangen; Peter Schardt, Roettenbach, both of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/134,930

(22) Filed: Aug. 17, 1998

(30) Foreign Application Priority Data

Aug. 18, 1997 (DE) ..... 197 35 741

(51) Int. Cl.[7] ..... H05G 1/34; H05G 1/52; H01J 35/14

(52) U.S. Cl. ..... 378/113; 378/138; 378/109

(58) Field of Search ..... 378/113, 138, 378/136, 110, 109, 106

(56) References Cited

U.S. PATENT DOCUMENTS

| | | | | |
|---|---|---|---|---|
| 4,159,436 | * | 6/1979 | Ely | 313/57 |
| 5,617,464 | | 4/1997 | Mika et al. . | |
| 5,748,701 | * | 5/1998 | Mika et al. | 378/109 |
| 5,910,974 | * | 6/1999 | Kuhn et al. | 378/138 |

* cited by examiner

*Primary Examiner*—Frank G. Font
*Assistant Examiner*—Armando Rodriguez
(74) *Attorney, Agent, or Firm*—Schiff Hardin & Waite

(57) ABSTRACT

In a method and x-ray system for controlling the electron current in an x-ray tube emitted from a continuously heated electron emitter with an allocated focussing electrode to an anode, the potential of the focussing electrode is pulsed between a conducting-state voltage, selected dependent on the desired size of the focal spot and/or the tube voltage of the electron beam on the anode, and a blocking voltage interrupting the electron current to the anode, the pulsewidth being modulated to control the electron current.

20 Claims, 3 Drawing Sheets

METHOD FOR CONTROLLING THE ELECTRON CURRENT IN AN X-RAY TUBE, AND X-RAY SYSTEM OPERATING ACCORDING TO THE METHOD

BACKGROUND OF THE INVENTION

Field of the Invention

The present invention relates to a method for controlling the electron current flowing in an x-ray tube in the form of an electron beam propagating between an electron emitter and an anode, the electron emitter having a focussing electrode and being continuously heated during the operation of the x-ray tube the electron beam striking the anode in a focal spot, with the tube voltage being across the electron emitter and the anode, and the focal electrode being at a focussing electrode potential. The invention also relates to an x-ray system operating according to this method.

In contemporary x-ray tubes, continuously heated tungsten helical coil is employed as the electron emitting component almost exclusively. The tube current—i.e. the electron current emanating from the electron emitter given a defined tube voltage—is therein determined by the temperature of the helix, which is adjusted by the heating current through the tungsten helix. Because of the low heating capacity of the tungsten helix it is possible to rapidly alter the tube current while maintaining the respective size of the focal spot by altering the heating current, which is necessary for many medical recording techniques. In continuously heated low-temperature emitters which are fashioned from materials—e.g. $LaB_6$—with a lower specific electron work function than tungsten and which as a rule have a significantly higher heating capacity than tungsten, alterations of the tube current at the filament are not possible with the same speed as with a tungsten helix, which is why low-temperature emitters cannot be employed everywhere. In many modern x-ray tubes—e.g. rotating bulb tubes with central emitters or x-ray tubes with oblique bombardment—round emitters with a small emission surface and a high emission current are needed to generate an electron beam with an approximately circular cross-section. The known tungsten helices are unsuitable for these tube geometries. The low-temperature emitters that are otherwise suitable, however, cannot bear rapid temperature changes such as are necessary for medical recording techniques with rapidly varying tube current. If a low-temperature emitter should be employed despite this, then the controlling of the tube current—i.e. the adjustment of the electron current—must occur in a different way than by alteration of the heating current. This can be effected by an additional electrode, for example a grid connected upstream, a Wehnelt cylinder or a focussing electrode at a different potential than that of the electron emitter. A disadvantage of such approaches, however, is that the potential distortion brought about by the additional electrode simultaneously influences the spread of the electron beam such that the abovementioned arrangement is only suitable for turning the electron current, and thus the tube current, on and off in alternation, but is not suitable for variable control without simultaneously adversely influencing other focussing, and thus the size of the focal spot dependent on the potential at the additional electrode, and thus on the tube current.

An x-ray tube having the capability of adjusting of the tube current but without any consideration of the tube voltage and/or the size of the focal spot, known from U.S. Pat. No. 5,617,464.

SUMMARY OF THE INVENTION

It is an object of the present invention to provide a method and a device of the abovementioned type wherein variable current control is possible with constant focussing, i.e. with constant size of the focal spot.

This object is inventively achieved in a method for controlling the electron current flowing in an x-ray tube in the form of an electron beam between an electron emitter with focussing electrode and an anode, the emitter being continuously heated during the operation of the x-ray tube wherein the electron beam strikes the anode in a focal spot, and wherein tube voltage is across the electron emitter and the anode, and wherein the potential at the focal electrode is pulsed with a pulse frequency between a conducting-state voltage, selected dependent on the desired size of the focal spot and/or the tube voltage, and a blocking or reverse voltage interrupting the electron current to the anode, the pulse width being modulated (adjusted) to control the electron current.

The inventive method thus provides a pulse width-modulated current control for an x-ray tube. The potential at the focussing electrode is altered in pulse-like fashion with a pulse frequency between two fixed voltages, namely a conducting-state voltage —given which the field generated by the focussing electrode allows the electrons emitted at the electron emitter reach the anode—and a blocking voltage—given which the field generated by the focal electrode completely shields the electrons emitted at the electron emitter from the anode. The conducting-state voltage is inventively selected such that a defined focus is set, i.e., a focal spot of the desired size is generated on the anode. The desired size of the focal spot is thus the factor according to which the amplitude of the conducting-state voltage is selected. In addition, in the case of x-ray tubes with adjustable tube voltage the amplitude of the conducting-state voltage depends on the prevailing tube voltage, which is likewise considered in the selection of the amplitude of the conducting-state voltage.

The electron beam between the electron emitter and the anode is thus switched on and off in alternation, whereby in the on-condition a focal spot of the desired size is generated on the anode as a result of the conducting-state voltage, which is selected corresponding to the desired size of the focal spot dependent on the prevailing tube voltage, if necessary. The control of the effective chronologically averaged flowing tube current occurs by pulse width modulation, i.e., by adjusting (corresponding to the desired tube current) the duration of the time intervals during which the focussing electrode is at the conducting-state voltage. In this way, the invention allows an altering of the tube current without influencing the size of the focal spot. This holds true regardless of the type of the electron emitter which is employed, i.e. also for a continuously heated low-temperature emitter. As a consequence of the pulse width modulation, rapid modifications of the tube current such as are necessary in many medical recording techniques thus are possible without influencing the size of the focal spot.

In an embodiment of the invention the pulse frequency is greater than 1 kHz, this frequency being selected from a range between 1 kHz and 10 kHz, in particular. In the ideal case the time characteristic of the voltage at the focussing electrode corresponds to a rectangular curve. Such a curve is not exactly realizable in practice, however. In order to avoid only a gradual rise, or drop of the tube current due to excessively low edge steepnesses of the curve of the voltage at the focussing electrode, rather than the rectangular alteration desirable per se, in an embodiment of the invention the edge steepness with which the voltage at the focal electrode is altered between the blocking voltage and the conducting-state voltage, and vice versa, is selected such that the time in which the voltage at the focussing electrode is switched from the blocking voltage into the conducting-state voltage and vice versa is shorter than 100 $\mu$s, particularly shorter than 10 $\mu$m. The times in the range of 10 $\mu$m and smaller can still be achieved without great outlay.

In x-ray systems employed in medicine, for example, a detector system is disposed in the path of x-rays emitted from the x-ray tube. If the tube current, and thus the generated x-ray radiation, is pulsed in the manner described, this also affects the image recording behavior of the detector system. In order to account for this, in an embodiment of the invention the pulse frequency is selected dependent on the image recording frequency of a detector system connected to the x-ray tube downstream, with the selected frequency of repetition, i.e. the pulse frequency, being considerably above the image recording frequency of the detector system, e.g. an x-ray film, an image intensifier with a video chain, or the like. For systems wherein the image recording frequency is very high, e.g. in computed tomography systems wherein up to 4000image pick-ups per second occur, the pulse operation can be inventively synchronized with the image recording operation of the detector system connected to the x-ray tube downstream, particularly using a PLL (phase locked loop). It is thus possible to match the pulse operation and the image recording operation by means of the synchronization such that even given very high image recording frequencies, the pulse operation can be set so that one or more pulse-like alterations of the voltage at the focussing electrode occur per pick-up.

The initially-cited object is also inventively achieved in an x-ray system with an x-ray tube having an electron emitter with an allocated focussing electrode, the emitter being heated continuously during the operation of the x-ray tube, and an anode, with an electron current in the form of an electron beam flows between the electron emitter and the anode, so that the electron beam strikes the anode in a focal spot, the tube voltage being across the electron emitter and the anode, and having a control means for pulsing the potential at the focussing electrode with a modulated pulse frequency between a conducting-state voltage, selected dependent on the desired size of the focal spot and/or the tube current, and a blocking voltage, which interrupts the electron current to the anode—in order to control the electron current.

From the above discussion of the inventive method, it is clear that the control means for the inventive x-ray system allow adjustment of the tube current without influencing the size of the focal spot. According to a preferred embodiment of the invention a memory is provided in which values for the conducting-state voltage are stored dependent on various sizes of the focal spot and/or tube voltage amplitudes. In the setting of the required conducting-state voltage, the control unit can refer to the values in the memory, experimentally obtained values, for example, without having to obtain these values anew by calculation, for example.

Preferably, the focussing electrode is inventively arranged in essentially annular fashion and the electron emitter is arranged centrically in the focussing electrode.

If the synchronization of the pulse frequency with the image recording operation of a detector system is necessary, the detector system receiving radiation emitted from the x-ray tube, the control means can include a PLL for avoiding image degradation due to the pulsed control.

DESCRIPTION OF THE PREFERRED EMBODIMENTS

Figure 1:
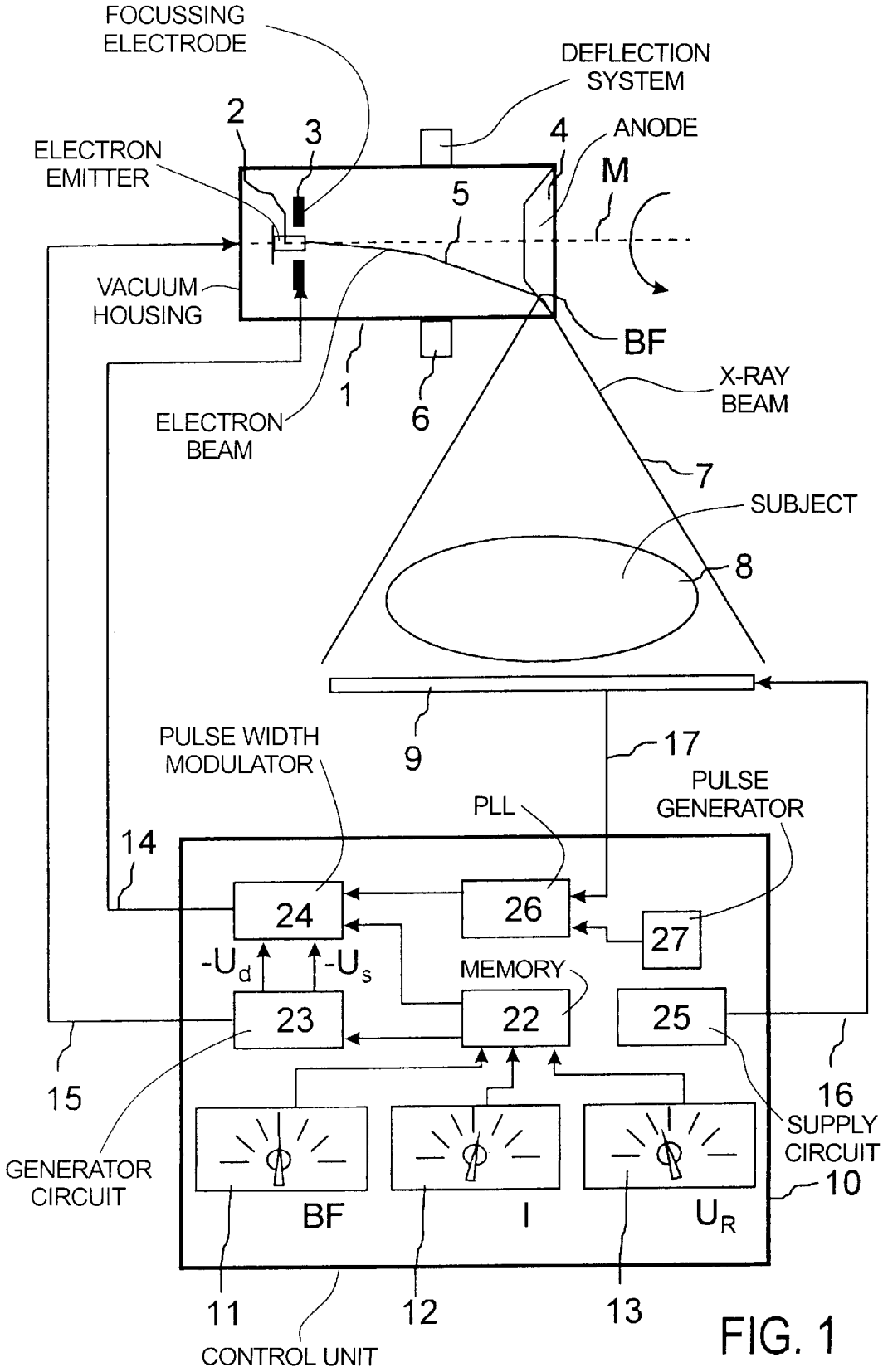
FIG. 1 is a schematic block diagram of an x-ray system constructed and operating in accordance with the invention.

FIG. 1 shows an inventive x-ray system which functions according to the inventive method. This system includes an x-ray tube having vacuum housing 1 containing a continuously heated electron emitter 2, arranged at the cathode side, and a focussing electrode 3 allocated thereto (i.e., the focussing electrode 3 produces a field which interacts with the electron beam emitted by the electron emitter 2). An anode 4 is additionally received in this vacuum housing 1, the anode 4 being securely connected to the vacuum housing 1. The x-ray tube is a type known as a rotating bulb tube, whereby the vacuum housing 1 rotates about an axis M on which the electron emitter 2 is arranged. A deflection system 6—e.g. an electromagnetic system—surrounding the vacuum housing 1 is provided in order to deflect and focus the electron beam 5 emitted by the electron emitter 2 onto a focal spot BF on the disk-like anode 4 at a location which is eccentric with respect to the center axis M.

The x-ray radiation 7 emanating from the focal spot BF irradiates a subject 8 and is picked up by a detector system 9, for example an image intensifier.

The x-ray system additionally contains a control unit, generally referenced 10, which controls the entire operation of the x-ray system and which is schematically depicted in FIG. 1.

The control unit 10 includes adjustment elements for altering the size of the focal spot BF, and the respective amplitudes of the tube current I and the tube voltage $U_R$ in the form of adjusting knobs 11, 12 and 13, for example. The control unit 10 supplies the x-ray tube with all the voltages and currents necessary for the operation of the x-ray tube, e.g. the tube voltage $U_R$ across the electrode emitter 2 and the anode 4, the heating current $I_H$ necessary for the operation of the electron emitter 2, the currents necessary for the operation of the deflection system 6 and a focussing voltage $U_F$ fed to the focussing electrode 3 which will be explained in detail. In FIG. 1 this is indicated by a line 14 connecting the control unit 10 and the x-ray tube and by a line 15 connecting the focal electrode 3 with the control unit 10.

The control unit 10 additionally supplies the detector system 9 with the necessary voltages and currents according to the type of detector system via line 16. Signals—namely a signal corresponding to the image recording frequency—are also fed from the detector system 9 via a line 17 to the control unit 10 for a purpose explained below.

Figure 2:
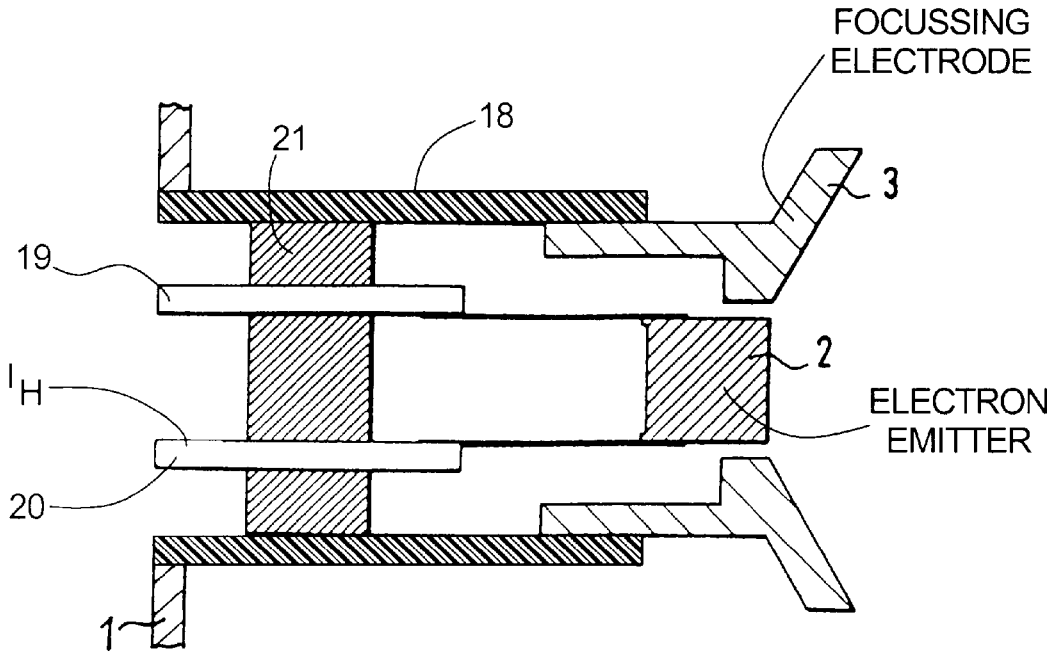
FIG. 2 is a sectional view of a cathode structure for generating a round beam using a constantly heated emitter in the context of the inventive method and system.

FIG. 2 shows the construction of the cathode arrangement of the x-ray tube of FIG. 1 in detail. In this exemplary embodiment—e.g. a low-temperature emitter—the electron emitter 2 has a flat, annular emission surface and is arranged centrically in the annularly fashioned focussing electrode 3. The focussing electrode 3 is insulated relative to the vacuum housing by an insulator 18. The electron emitter 2 is heated with the heating current $I_H$ via the terminal lines 19 and 20, which are led out of the vacuum housing 1 through an electrically insulating vacuum lead-through 21. When the electron emitter 2 is heated, electrons emerge particularly in the region of the annular emission surface, which are accelerated in the electrical field which is present as a consequence of the tube voltage $U_R$ between the electron emitter 2 and the anode 4. The electrons are accelerated in the direction of the anode 4 as an electron beam 5 having a substantially annular cross-section (indicated in hatched fashion in FIG. 2). The electrons then strike the anode 4 in the focal spot BF.

It is possible to adjust the size of the focal spot BF on the anode 4 by means of the potential at the focussing electrode 3 in the form of a focussing voltage $-U_F$. To this end the focussing electrode 3 lies at a negative potential relative to the potential of the electron emitter 2. As a result, the electron current flowing between the electron emitter 2 and the anode 4 and corresponding to the to the tube current I becomes lower as the potential of the focussing electrode 3 becomes more negative relative to the potential of the electron emitter 2. Besides this, the potential at the focussing electrode 3 influences the diameter d of the electron beam 5 and thus the size of the focal spot BF.

Figure 3:
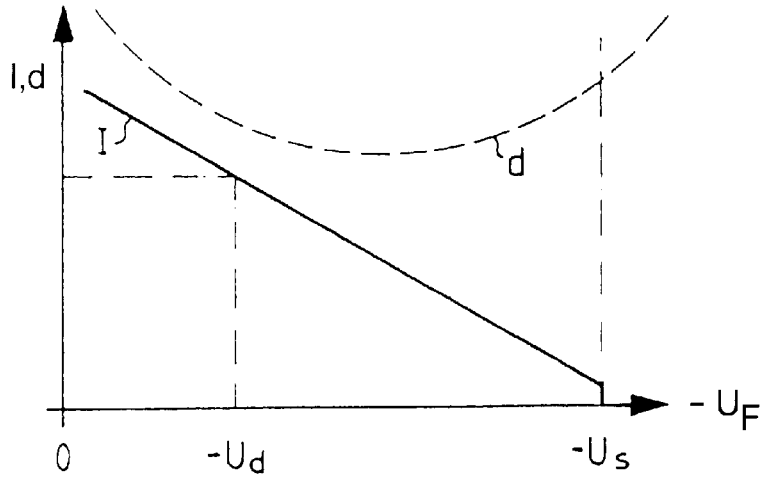
FIG. 3 is a diagram for depicting the tube current and diameter of the electron beam on the anode as a function of the voltage at the focussing electrode, in accordance with the invention.

FIG. 3 depicts the tube current I and the diameter d of the electron beam as a function of the negative focussing voltage $-U_F$ at the at the focussing electrode 3. With the rising of the negative focussing voltage $-U_F$ the diameter d of the electron beam 5, and thus the size of the focal spot BF on the anode 4, decreases until a minimum is reached, after which an increase in diameter occurs. This "crossover effect" is known. As additionally shown in FIG. 3, the tube current I decreases with an increase of the negative focussing voltage $-U_F$. This is because in that the electrical field which is present as a consequence of the negative focussing voltage $-U_F$ at the focussing electrode 3 leads to an increasingly stronger shielding of the electron emitter 2 relative to the anode 4, until the focussing voltage $-U_F$ reaches a blocking voltage $-U_s$ whereby a complete shielding of the electron emitter 2 is effected and no more electrons are let through to the anode 4.

Figure 4:
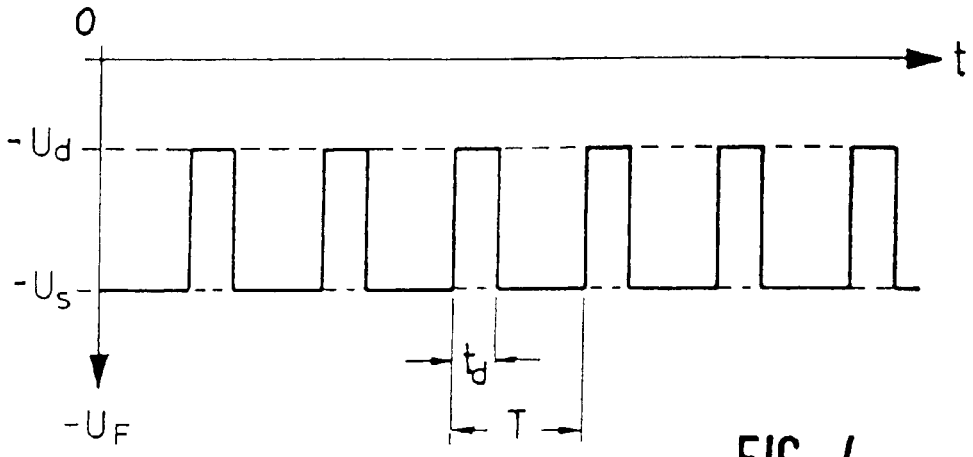
FIG. 4 is a diagram for depicting the time characteristic of the voltage at the focal electrode in he pulse operation in accordance with the invention.

From FIG. 4, which depicts the time characteristic of the focussing voltage $-U_F$ at the focussing electrode 3, it is clear that the focussing electrode 3 does not lie at a constant potential, but that the focussing voltage $U_F$ is altered in pulse-like fashion with a pulse frequency that corresponds to a period duration T between the conducting-state voltage $-U_d$ (also shown in FIG. 3) and the negative blocking voltage $-U_s$ (likewise shown in FIG. 3), resulting in a substantially rectangular signal curve.

The conducting-state voltage is selected in consideration of the respectively set tube voltage $U_R$ so that a diameter e of the electron beam 5 is achieved which leads to a focal spot BF of the desired size. The pulse duration (pulse width) $t_d$—during which the focal electrode 3 is of the conducting-state voltage $U_d$ is adjusted in consideration of the tube voltage $U_R$ —selected by means of the adjusting knob 13—and of the size of the focal spot BF—selected by means of the adjusting knob 11—such that, viewed over time, an average tube current I results which corresponds to the tube current I set by means of the adjusting knob 12.

Thus by alteration of the pulse width $t_d$,—i.e. by pulse width modulation, it is possible to vary the average tube current I without causing a change in the size of the focal spot BF, since the conducting-state voltage $U_d$ which is decisive for the size of the focal spot BF remains unaltered.

The operation of the inventive x-ray system preferably occurs with a frequency greater than 1 kHz.

Since the emission of electrons is only possible if the value of the prevailing focussing voltage is $-U_d$, the average tube current I results according to:

$I=I_d*(t_d/T)$, with $t_d$=pulse duration

T=period $I_d$=maximal current at $U_d$.

In this way it is possible to adjust the tube current I for a given focussing voltage continuously between I=0 and $I=I_d$.

For all combinations of tube voltage $U_R$, tube current I and size of the focal spot BF that can be set by means of the adjusting knobs 11 to 13, the appertaining values for the conducting-state voltage $-U_d$ and the pulse width $_{Tb}$ are stored in a memory 22 of the control unit 10, which feeds the corresponding values to an electrical generator circuit 23 and to a pulse width modulator 24 dependent on the respective settings of the adjusting knobs 11 to 13. This is illustrated in FIG. 1 by connections of the adjusting knobs 11 to 13 to the memory 22.

The electrical generator circuit 23, which also supplies the x-ray tube with the tube voltage $U_R$ and the heating current $I_H$, then feeds the correspondingly set conducting-state voltage $-U_d$ and the blocking voltage $-U_S$ to the pulse width modulator 24. The pulse width modulator then generates the focussing voltage $-U_F$ with a pulse width $t_d$ corresponding to the selected setting.

In the case of the exemplary embodiment, the control unit 10 also contains a supply circuit 25 for the detector system 9.

The control unit 10 further contains a PLL 26 whose output is connected to the pulse width modulator 24 and which feeds a signal corresponding to the pulse frequency with the period T thereto. The PLL 26 generates this signal from a signal that is delivered by a pulse generator 27 and fed to the one input of the PLL 26, the frequency thereof corresponding to the sampling frequency as well as to a signal that is fed to the other input of the PLL 26 via the line 17 and that corresponds to the image recording frequency of the detector system 9.

Thus the pulses of the focussing voltage $-U_F$ at the focussing electrode 3 are synchronized with the image recording frequency of the detector system 9.

Figure 5:
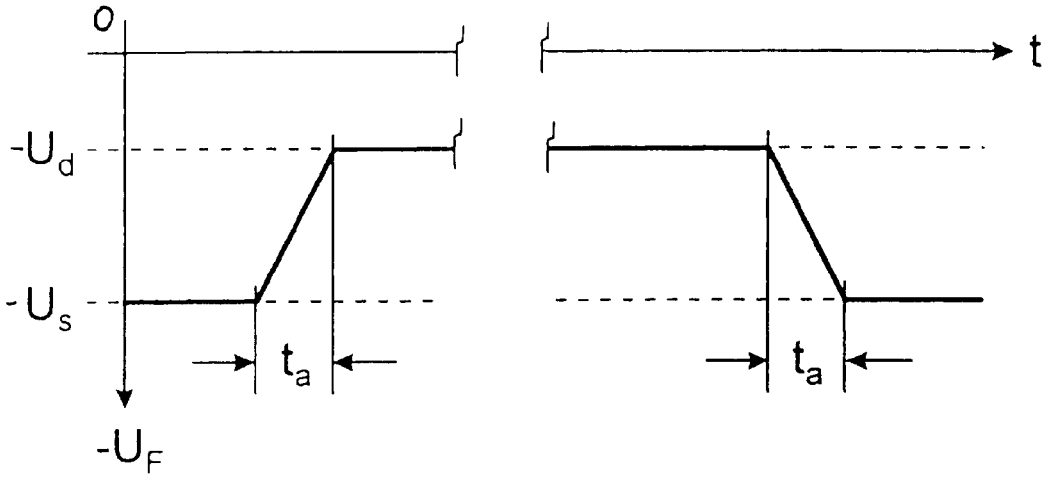
FIG. 5 is an excerpt of the diagram according to FIG. 4, with the time axis expanded.

As can be seen from FIG. 5, which shows an excerpt of FIG. 4 with time axis t highly spread and also interrupted in the region of the pulse duration, the period $t_a$ in which the focussing voltage $U_F$ is switched from the blocking voltage $U_S$ to the conducting-state voltage $U_d$ and vice versa is small in relation to the pulse duration $t_d$ and is shorter than 100 $\mu$s, particularly shorter than 10 $\mu$s.

The electron emitter 2 is preferably continuously supplied with a constant heating current $I_H$. In addition to adjusting the tube current I by pulse width modulation, however it is also possible in the framework of the invention to adjust the tube current I by an alteration of the heating current $I_H$.

In the exemplary embodiment the tube voltage $U_R$ and the size of the focal spot BF are adjustable. The invention can also be utilized if the tube voltage $U_R$ is fixed and only the size of the focal spot is adjustable, or if the size of the focal spot BF is fixed and only the tube voltage $U_R$ is adjustable.

Also, in the case of the exemplary embodiment a low-temperature emitter is provided which generates an electron beam of annular cross-section. In the framework of the invention different electron emitters can be employed other than low-temperature emitters. Furthermore, within the framework of the invention electron emitters can be employed from which an electron beam emanates whose cross-section is not annular. The x-ray tube in the exemplary embodiment is a type known as a rotating tube. Conventional rotating anode x-ray tubes or stationary anode tubes also can be employed in the framework of the invention.

Although various minor modifications might be suggested by those skilled in the art, it should be understood that our wish to embody within the scope of the patent warranted hereon all such modifications as reasonably and properly come with the scope of our contribution to the art.

We claim as our invention:

1. A method for controlling an electron current in an x-ray tube, comprising the steps of:

continuously heating an electron emitter during operation of an x-ray tube containing said electron emitter to emit an electron beam from said electron emitter;

causing said electron beam to strike an anode in said x-ray tube at a focal spot on said anode, said focal spot having a focal spot size, said anode thereupon emitting x-rays;

producing a tube voltage across said electron emitter and said anode, said tube voltage having a tube voltage amplitude;

disposing a focussing electrode at said electron emitter, said focussing electrode having a focussing field which interacts with said electron beam, said focussing electrode being at a focussing electrode potential;

pulsing said focussing electrode potential at a pulse frequency between a conducting state voltage which allows passage of said electron beam through said focussing electrode and a blocking voltage which interrupts said electron beam to control an electron current associated with said electron beam; and selecting said pulse frequency dependent on both said focal spot size and said tube voltage amplitude.

2. A method as claimed in claim 1 wherein the step of pulsing said focussing electrode potential comprises pulsing said focussing electrode potential at a pulse frequency greater than 1 kHz.

3. A method as claimed in claim 1 wherein the step of pulsing said focussing electrode potential comprises pulsing said focussing electrode potential at a pulse frequency between 1 kHz and 10 kHz.

4. A method as claimed in claim 1 wherein the step of pulsing said focussing electrode potential comprises pulsing said focussing electrode potential to produce a rise time between said blocking voltage and said conducting-state voltage of less than 100 $\mu$s.

5. A method as claimed in claim 1 wherein the step of pulsing said focussing electrode potential comprises pulsing said focussing electrode potential to produce a rise time between said blocking voltage and said conducting-state voltage of less than 10 $\mu$s.

6. A method as claimed in claim 1 comprising the additional steps of:

detecting said x-rays with a radiation detector having an image recording frequency associated therewith; and selecting said pulse frequency dependent on said image recording frequency.

7. A method as claimed in claim 6 wherein the step of selecting said pulse frequency dependent on said image recording frequency comprises synchronizing said pulse frequency with said image recording frequency.

8. A method as claimed in claim 7 wherein the step of synchronizing said pulse frequency with said image recording frequency comprises employing a phase-locked loop to synchronize said pulse frequency with said image recording frequency.

9. An x-ray system comprising:

an x-ray tube containing an electron emitter which emits an electron beam, an anode on which said electron beam is incident at a focal spot having a focal spot size, said anode emitting x-rays from said focal spot;

means for continuously heating said electron emitter during operation of said x-ray tube for causing said electron emitter to emit said electron beam;

means for producing a tube voltage across said electron emitter and said anode, said tube voltage having a tube voltage amplitude;

a focussing electrode disposed in said x-ray tube at said electron emitter having a focussing electrode field which interacts with said electron beam, said focussing electrode being at a focussing electrode potential; and control means for pulsing said focussing electrode potential with a modulated pulse frequency between a conducting state voltage which allows passage of said electron beam through said focussing electrode and a blocking voltage which interrupts said electron beam, for controlling an electron current associated with said electron beam dependent on both said focal spot size and said tube voltage amplitude.

10. An x-ray system as claimed in claim 9 further comprising memory means, accessible by said control means, for storing a plurality of values of said conducting stage voltage dependent on respective focal spot sizes.

11. An x-ray system as claimed in claim 9 further comprising memory means, accessible by said control means, for storing a plurality of values of said conducting stage voltage dependent on respective tube voltage amplitudes.

12. An x-ray system as claimed in claim 9 further comprising memory means, accessible by said control means, for storing a plurality of values of said conducting stage voltage dependent on respective focal spot sizes and tube voltage amplitudes.

13. An x-ray system as claimed in claim 9 wherein said focussing electrode comprises an annular electrode, and wherein said electron emitter is disposed centrally within said focussing electrode.

14. An x-ray system as claimed in claim 9 wherein said control means comprises means for pulsing said focussing electrode potential at a pulse frequency which is greater than 1 kHz.

15. An x-ray system as claimed in claim 9 wherein said control means comprises means for pulsing said focussing electrode potential at a pulse frequency between 1 kHz and 10 kHz.

16. An x-ray system as claimed in claim 9 wherein said control means comprises means for pulsing said focussing electrode potential with a rise time between said conducting-state voltage and said blocking voltage which is less than 100 $\mu$s.

17. An x-ray system as claimed in claim 9 wherein said control means comprises means for pulsing said focussing electrode potential with a rise time between said conducting-state voltage and said blocking voltage which is less than 10 $\mu$s.

18. An x-ray system as claimed in claim 1 further comprising a radiation detector for detecting the x-rays emitted from said anode, said radiation detector operating at an image recording frequency; and said control means comprises means for pulsing said focussing electrode potential at a pulse frequency dependent on said image recording frequency.

19. An x-ray system as claimed in claim 18 wherein said control means comprises means for pulsing said focussing electrode potential at a pulse frequency synchronized with said image recording frequency.

20. An x-ray system as claimed in claim 19 wherein said control means comprises a phase-locked loop for synchronizing said pulse frequency with said image recording frequency.

* * * * *